US006052962A

United States Patent [19]

Ghali et al.

[11] Patent Number: 6,052,962

[45] Date of Patent: Apr. 25, 2000

[54] DOWEL SUPPORT FOR BENT-UP REINFORCEMENT BARS AND PROCESS FOR THE PRODUCTION THEREOF

[76] Inventors: Amin Ghali, 3911 Vincent Drive N.W., Calgary, Canada, T3A 0G4; Walter Dilger, 592 Dalmeny Hill N.W., Calgary, Canada, T3A 1T6; Peter Ernst, Lindenstrasse 7, Hattersheim, Germany, 65795

[21] Appl. No.: 09/091,402

[22] PCT Filed: Dec. 19, 1996

[86] PCT No.: PCT/EP96/05698

§ 371 Date: Oct. 13, 1998

§ 102(e) Date: Oct. 13, 1998

[87] PCT Pub. No.: WO97/23695

PCT Pub. Date: Jul. 3, 1997

[30] Foreign Application Priority Data

Dec. 21, 1995 [CA] Canada ..... 2165848

[51] Int. Cl.[7] ..... E04C 3/20; E04C 5/00

[52] U.S. Cl. ..... 52/724.1; 52/334; 52/414; 52/600; 52/724.2

[58] Field of Search ..... 52/334, 724.1, 52/414, 600, 724.2

[56] References Cited

U.S. PATENT DOCUMENTS 4,406,103 9/1983 Ghali et al. ..... 52/260
5,655,349 8/1997 Ghali et al. ..... 52/724.1

FOREIGN PATENT DOCUMENTS

0495334 A1 8/1991 European Pat. Off. ..... 52/260

*Primary Examiner*—Carl D. Friedman
*Assistant Examiner*—Dennis L. Dorsey
*Attorney, Agent, or Firm*—Thomas E. Malyszko

[57] ABSTRACT

A studrail for shear reinforcement for reinforced concrete slabs is composed of a spacing rail (5) and a plurality of studs (6) which are arranged in parallel at a certain distance and provided with enlarged dish-like anchor heads (8) at both ends. The spacing rail (5), produced as a shaped sheet metal rail, grips one anchor head (8) of each stud with its two opposing folded flange edges (10).

19 Claims, 6 Drawing Sheets

Figure 1:
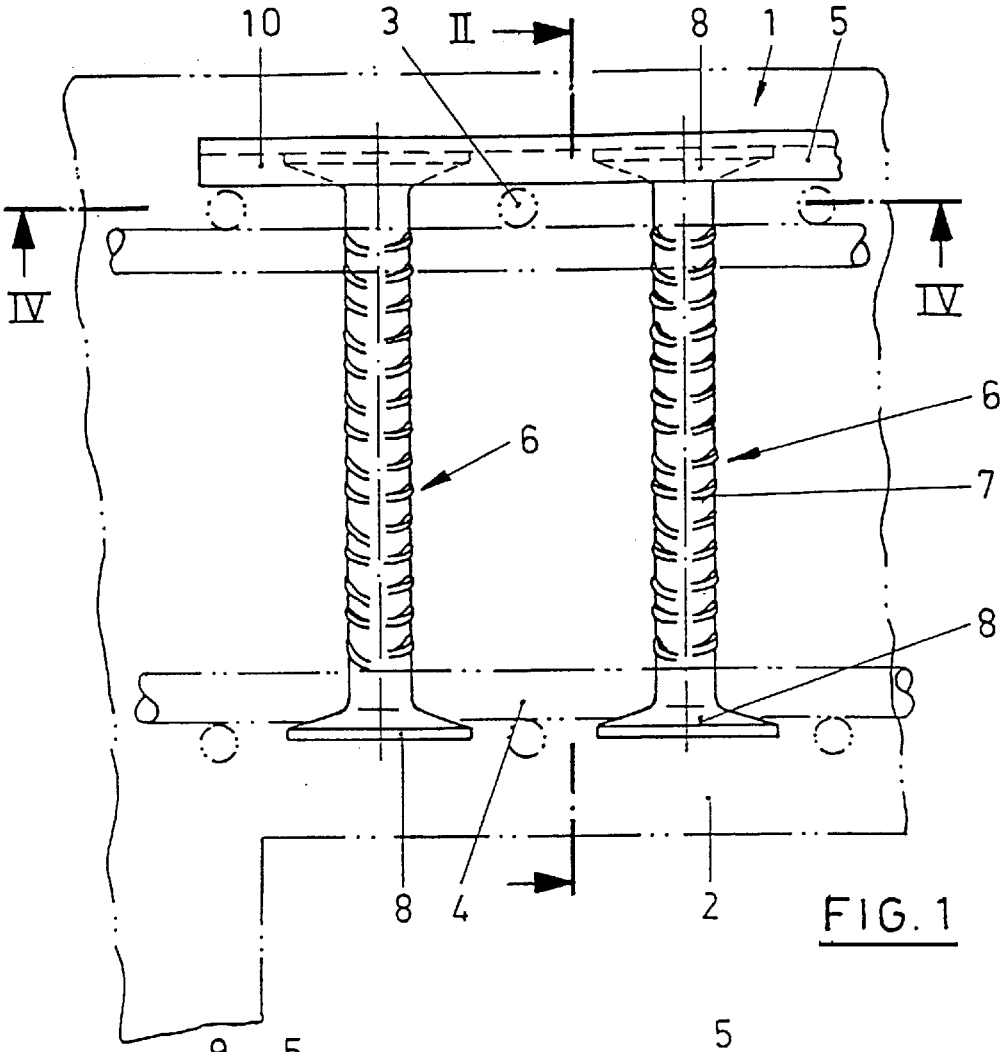

DOWEL SUPPORT FOR BENT-UP REINFORCEMENT BARS AND PROCESS FOR THE PRODUCTION THEREOF

The invention relates to a studrail for shear reinforcement in reinforced concrete slabs, consisting of a spacing rail and a plurality of parallel spaced studs that are clamped at one end by the rail. The studs consist of a shaft with disc shaped heads formed at both ends.

Shear reinforcement consisting of studrails are used in reinforced concrete slabs or beams in the area of supports, especially in the area of slab-column connections to resist the shear forces in the support area caused by the column reactions and as such serves as punching shear reinforcement.

The known studrail of the above-mentioned type (EP 0 495 334 B1) features studs with disc shaped heads only at one end and are welded to the rail at the other end. The production of the studrail is therefore rather elaborate. The heat generated by the welded connection may lead to a warping of the spacing rail, which must be straightened afterwards. Through the welding process, changes of material properties might occur in the stud that can lead to a reduced load bearing capacity.

The aim of the invention is therefore to develop the above-mentioned type of studrail such that the production is simplified and the welding is eliminated.

This objective is achieved by the invention by using a profiled sheet metal channel as the spacing rail, the base plate of which is in contact with the top face of the head of the stud and the folded flanges of the channel are enclosing the opposite edges of the head of the stud.

Herewith a simple tightly fitting connection between the studs and the spacing is achieved without any welding. Thus no heat-induced changes in the material properties occur in the stud head. A subsequent straightening of the studrail is not necessary because no warping will occur since there is no heat generated by the connection. The studrail can be readily produced in any length, can be easily stored and shipped, without the hazard that the spacing or alignment of the individual studs is changed.

The purely mechanical attachment of the stud and the spacing rail enables the selection of different material properties of the rail and the stud. This in particular facilitates the production of a stainless steel studrail. Since there is no possibility of corrosion of stainless steel, the required concrete cover beneath the spacing rail can be reduced in this case.

In their preferred form, the flanges of the channel enclose the edges of the stud head in a clamping manner. Alternatively, provisions could be made that each stud head has a limited movement along the spacing rail to allow the spacing of the studs to be adjusted after fabrication.

According to a preferred form, it is planned that on the base of the channel cross-section a projecting stop for the stud heads is provided at equal distances along the length of the channel. These stops could be lips punched out of the profile base and bent through an angle against which a stud head is held during the assemblage. Herewith an exact positioning of the studs is guaranteed.

The stops could also be projections that engage into a recess of a stud head. Those projections could be produced with a center-hole punch.

According to another advantageous form of the invention it is planned that openings are provided in the base plate of the channel. Thus an intense connection with the surrounding concrete is achieved.

In the base plate of the channel openings can be provided to support chairs. If the chairs are attached to the rail in such openings the same chairs can be used for different rail width, which means a simplification of storage. The openings can be elongated so that the chairs can be moved in the direction of the rail to facilitate an adjustment of the rail after the chair is attached to the formwork.

According to an advantageous modified form of the invention it is envisioned that the edges of the flanges of the spacing rail have edge strips bent outward. This arrangement will have the effect that the concrete in the area of the stud head and especially at the underside of the stud head, which is the face of the stem joined to the stud head, is confined so that even with a relative small stud head diameter it is possible that a highly stressed support of the stud head is achieved in the concrete.

Further advantageous design types of the invented studrail are subject of further sub-claims.

The invention also refers to a procedure for production of the above mentioned studrails.

This procedure is described by the following steps:

a) sheet metal strip is rolled from a sheet metal coil;

b) the edges of the metal strip are bent upwards;

c) one head of the studs is set into the shaped sheet metal strip;

d) sidewalls of the shaped strip are folded inwards to provide a clamping action on the stud heads.

In this way the studrail can be produced in a continuous extensively automated assembly and cut to the desired length. Advantageous forms of the invented production process are subject to further sub-claims.

Design examples of the invention are described in more detail and shown in the following drawings.

Figure 2:
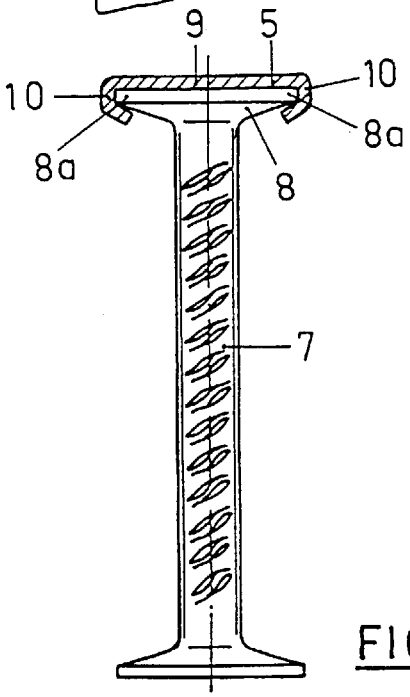
Figure 3:
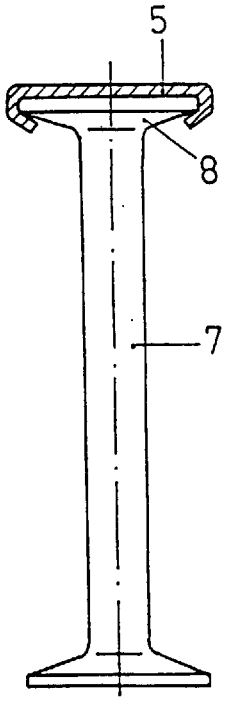
Figure 4:
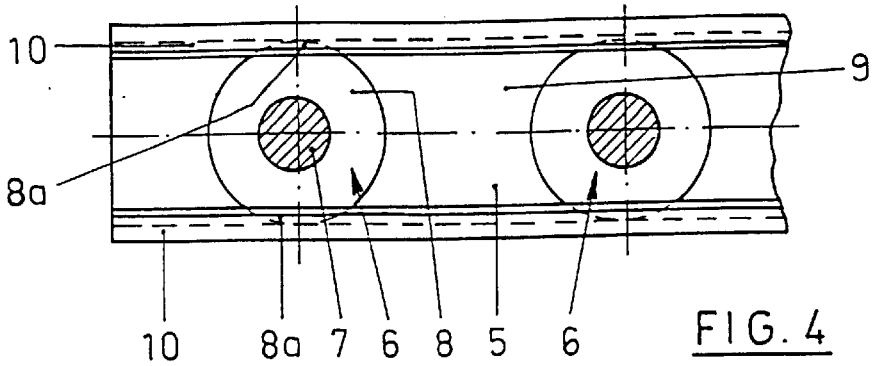
Figure 6:
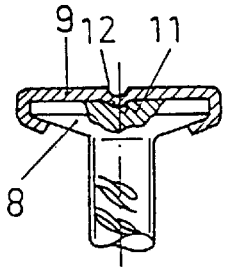
Figure 5:
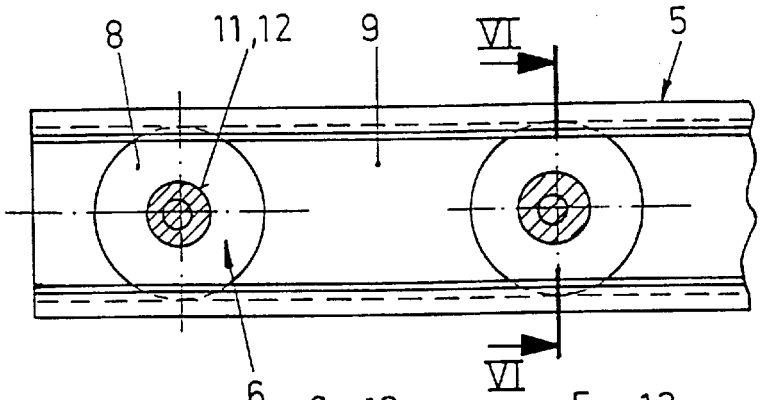
Figure 8:
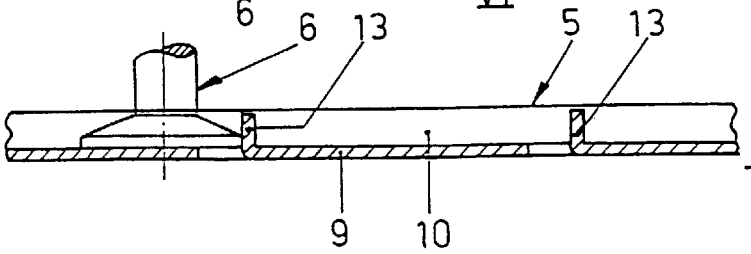
Figure 7:
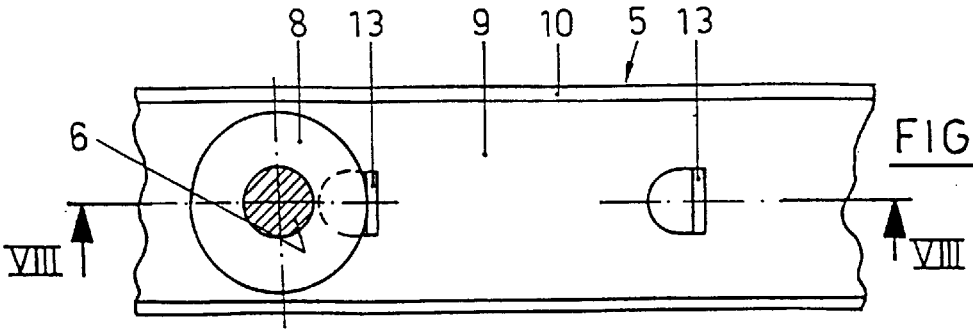

Shown in:

FIG. 1 is a section of a studrail in elevation and the contours of the reinforced concrete slab in which the studrail is embedded are indicated with dash-dotted lines, FIG. 2 is a view along the line II—II in FIG. 1, FIG. 3 is a view corresponding to FIG. 2 showing a modified form of production with smooth stud stems, FIG. 4 a view along the line IV—IV in FIG. 1, FIG. 5 Corresponds to FIG. 4 showing a modified form of production, FIG. 6 is a view along the line VI—VI in FIG. 5, FIG. 7 is a diagram similar to FIG. 4 showing another modified form of production of a studrail with sheet metal lips bent at an angel as stops for the studs, FIG. 8 is a view along line VIII—VIII in FIG. 7

Figure 9:
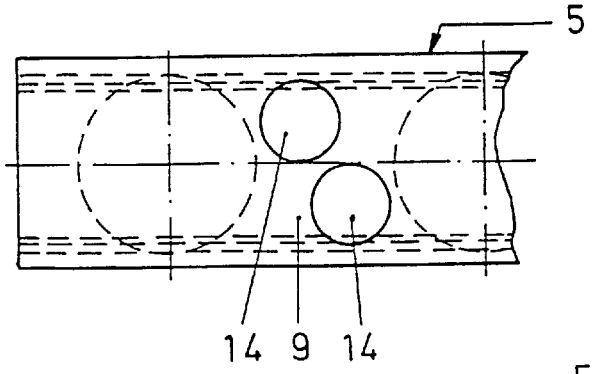
Figure 10:
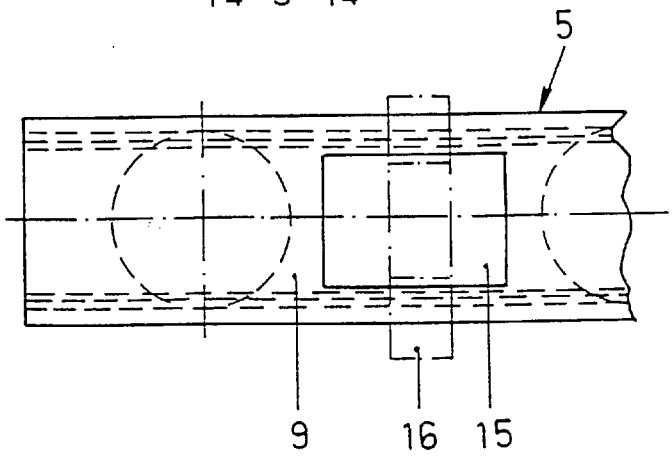
Figure 15:
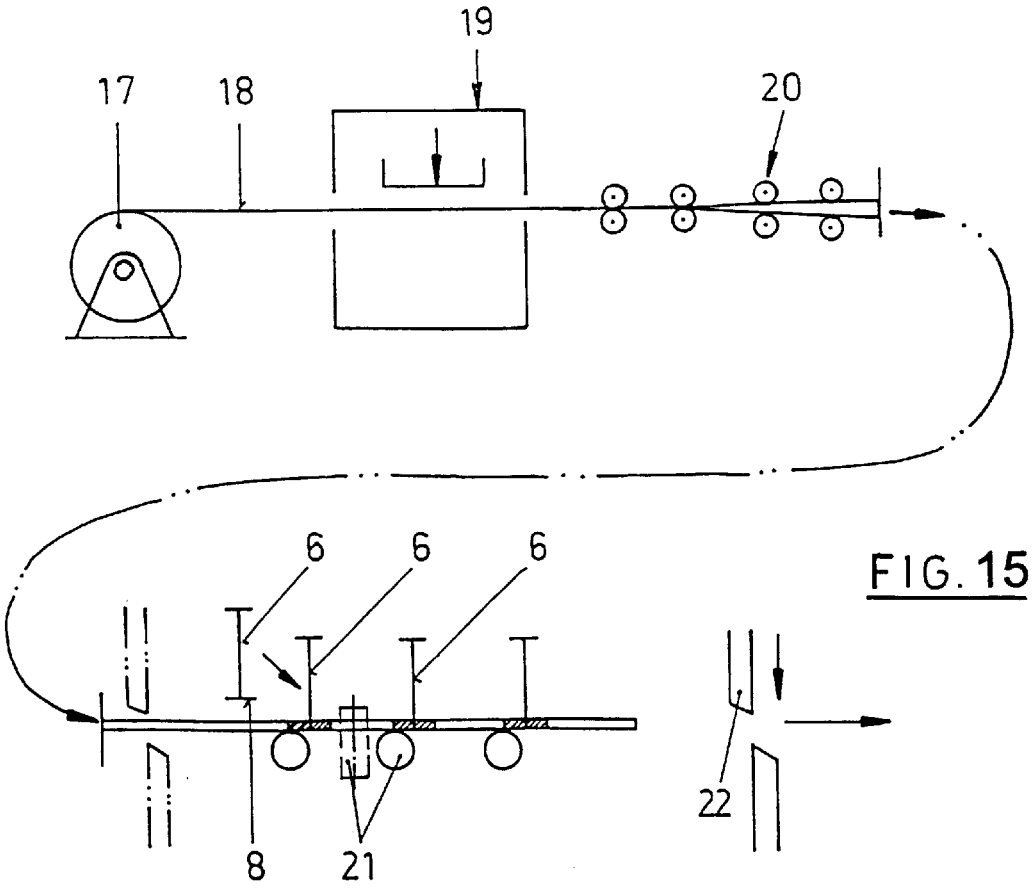
Figure 13:
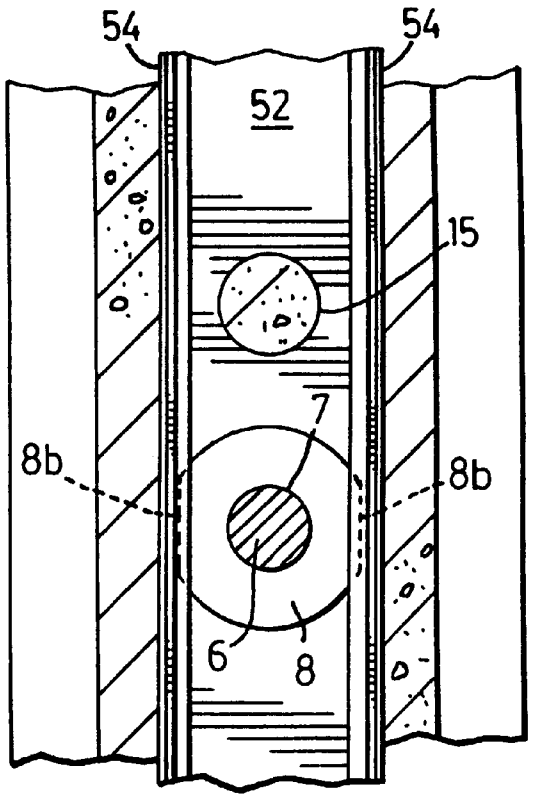
Figure 11:
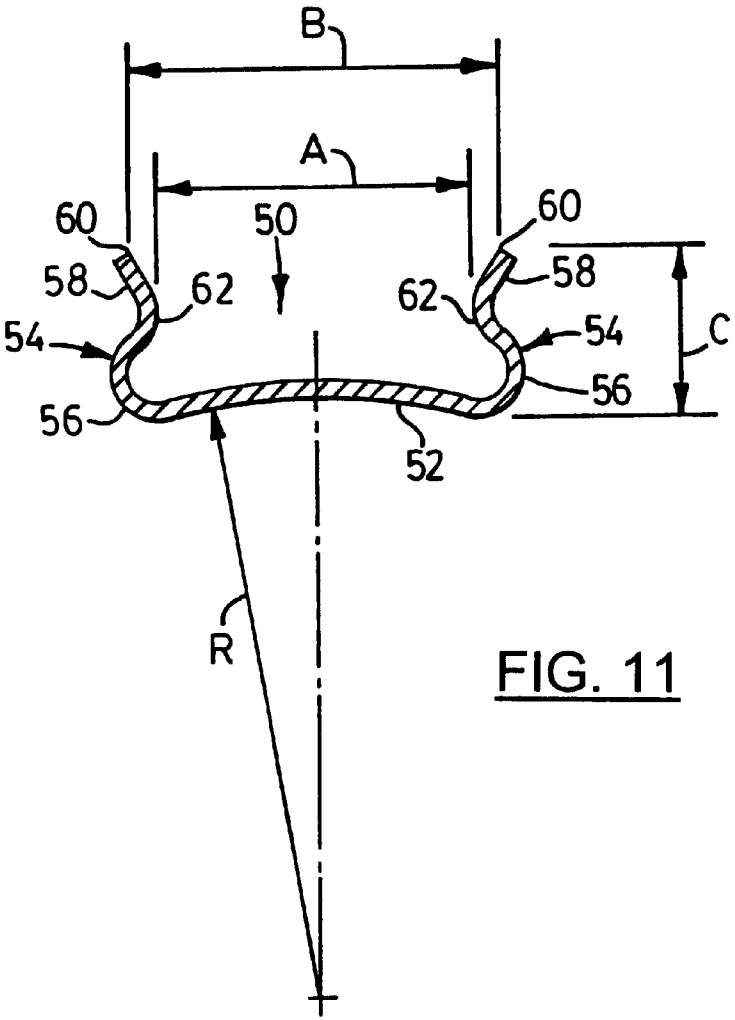
Figure 12:
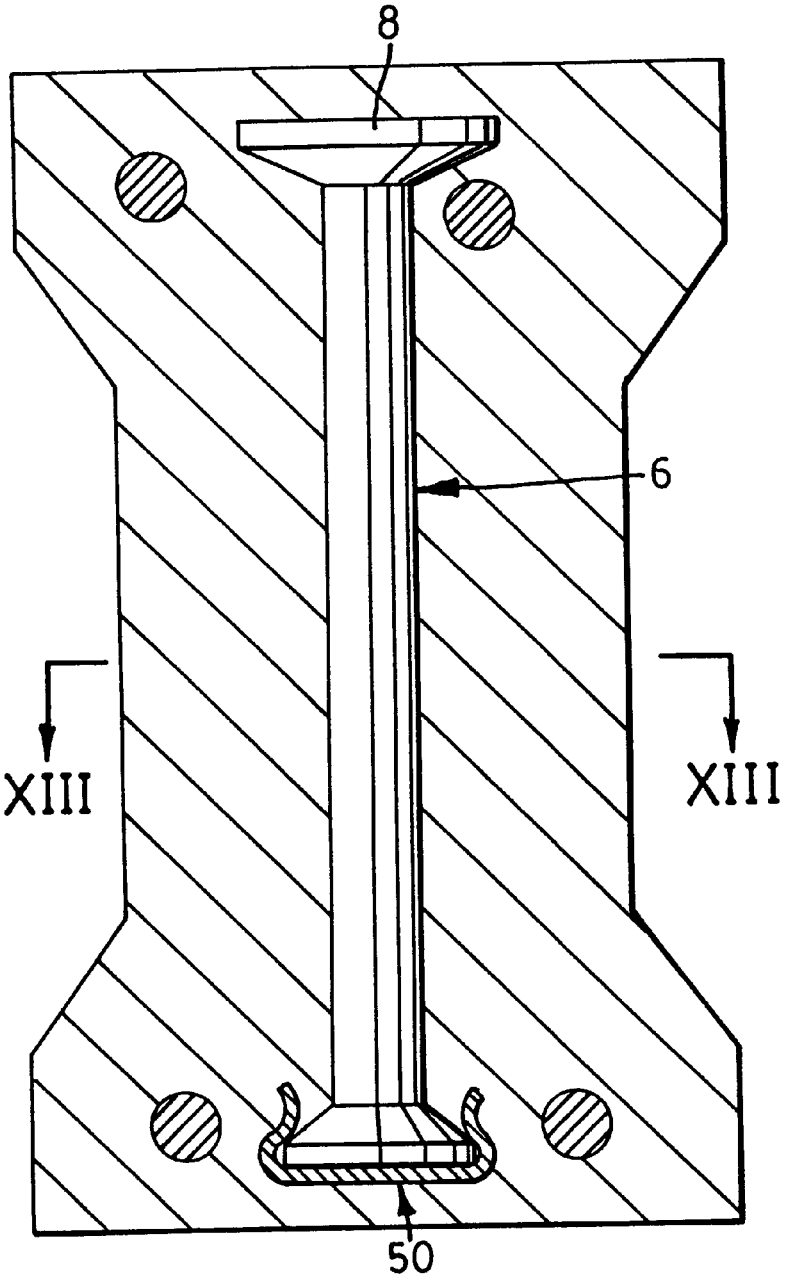
Figure 14:
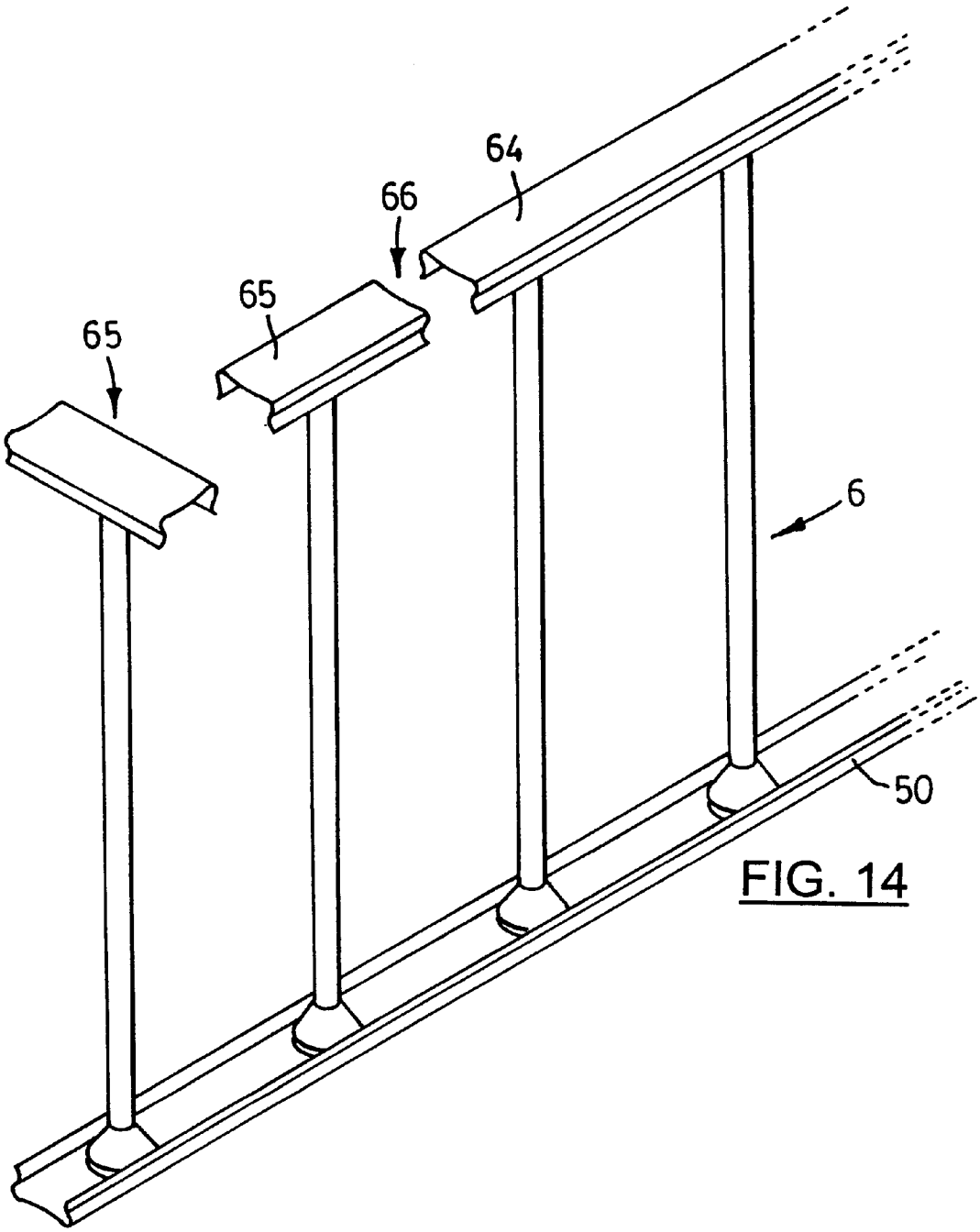

FIG. 9 is a top view of a studrail with openings in the bottom of the profile, FIG. 10 is a top view similar to FIG. 9 with an opening in the bottom of the profile, FIG. 11 is a cross section of a spacing rail in a modified form of production before inserting the studs, FIG. 12 is a vertical section through a reinforced concrete beam with a studrail, FIG. 13 is a view a long the line XIII—XIII in FIG. 12, FIG. 14 is a three dimensional diagram of another modified form of production of the studrail, and FIG. 15 is a schematic diagram of the production method for a studrail.

The studrail 1 shown in FIGS. 1, 2 and 4 is used to assemble shear reinforcement consisting of a plurality of studrails in a reinforced concrete slab 2 which has both a top 3 and bottom 4 layer of reinforcement. The studrail 1 consists of several studs 6 attached to a spacing trough or rail 5. The studs 6 are positioned parallel to each other and at a specified spacing. Each stud 6 has an elongate stud shaft 7 which consists of deformed reinforcing steel as shown in various forms in FIG. 1, 2 and 4. On both ends of the stud shaft 7 a disc shaped widened stud head 8 is provided.

One of the heads 8 of each stud 6 is attached to the spacing rail 5. The spacing rail 5 consists of a profiled sheet metal strip, which touches the flat base 9 to the top face of the upper stud heads 8. The two edges of the flanges 10 of the spacing rail 5 each enclose the opposite edges 8*a* of the stud head 8. Thus the stud head 8 is mechanically and tightly clamped to the spacing rail 5.

In FIG. 3 it is shown that stud shaft 7 can, unlike the FIG. 2 version, also be produced with a smooth surface.

In an alternate version shown in FIGS. 5 and 6, projections 11 are provided on the base of the rail 9 which engage in a central recess 12 in the stud head 8, as shown in the cross section of FIG. 6. The projections 11 can be made by a center hole punch on the outside of the base of the rail 9 and serve as a tightly fitting connection between the studs 6 and the spacing rail 5.

Unlike the above, the version in FIGS. 7 and 8 provides a lip 13 which is punched out of the base 9 of the spacing rail and bent. The lips 13 are for positioning of the stud heads 8. In FIGS. 7 and 8 the flanges 10 are shown in an intermediate stage of the production. The flanges 10 are bent through an angle for insertion of the stud heads 8. After positioning of the stud heads 8 at the lips 13 the flanges 10 are folded to fasten the stud heads 8 in the aforementioned manner. It is also possible to fold the flanges 10 in a manner to allow the possibility of later shifting the position of the studs 6. The movement could be limited by the lips 13 or in any other manner. Thus an adjustment of the studrail is possible.

FIG. 9 it is shown that openings 14 may be provided in the base 9 of the spacing rail 5 which improve the connection between the surrounding concrete and the spacing rail 5.

In FIG. 10 a rectangular opening 15 is presented which is cut out of the base of the spacing rail 9. A chair 16 can be inserted and held in position in this opening to maintain the minimum distance between the base of the spacing rail and the concrete formwork. If the length of the opening 15 is larger than the width of the chair 16 it is possible to adjust the position of the studrail relative to the chair 16 which is fastened to the formwork.

If the spacing rail 5 is fabricated from stainless steel, its distance to the concrete surface can be reduced to less than the minimum concrete cover required for steel susceptible to corrosion.

The cross-section of the spacing rail 50 shown in FIG. 11 is mainly U-shaped and also formed out of a single strip of sheet metal.

FIG. 11 shows the spacing rail 50 prior to inserting the studs 6.

Unlike the previously described example of the spacing rail where the base of the rail 9 is flat, the base of the spacing rail 52 illustrated in FIG. 11 has an inwardly convex curvature of a specified radius R prior to inserting the stud 6. On both sides of the base 52, the flanges 54 develop into an S-shaped cross section beginning at an inwardly concave clamping section 56 connected to the base 52. The two clamping sections 56 enclose the edges of the stud head 8 when assembled.

Above the clamping sections 56 there is an inwardly cambered section 62 which is adjacent to the edge strip 58. The two edge strips 58 of the spacing rail 50 diverge to the outside to facilitate the insertion of the stud heads 8 whereby the two edges of the flanges 54 act as a spring and can be bent outward. The stud head 8 is clamped by the springy spacing rail 50 as shown in FIGS. 12 and 13.

The uppermost edges 60 of the edge strip 58 of each flange 54 are spaced a distance B apart whereas the opening width A of the U-shaped spacing rail 50 is defined by the distance between the inwardly cambered sections 62. The height of the spacing channel is given as C. For a favorable configuration of a spacing rail 50 the following dimensions were selected:

a) the height C of the trough 50 is approximately 1.1 D where D is the diameter of the stud stem 7;

b) the radius of curvature of the rail base 52 is approximately 1.5 E where E is the diameter of the inserted stud head 8;

c) the distance between the profile edges 60 is approximately 0.95 E; and d) the opening width A between the inwardly cambered sections 62 is approximately 0.75 E before inserting the stud.

As shown in FIG. 13, the stud head 8 is flat 8*b* on two opposite edges which are aligned in the spacing trough 50. When inserting the stud 6 the head of the stud 8 has to be pressed against the flanges 54 to bend them outward so that the stud head 8 can be pressed through the inwardly cambered sections 62 to be positioned as shown in FIG. 12. The outward bent uppermost surface of the flange 58 serves as a lever to simplify the widening of the space between the sidewalls 54. When the stud head is mounted in the spacing rail 50 the face of the stud head is pressed to the cambered base of the rail 52 thus flattening the cambered base 52. The flanges 54 act like a spring. pressing the stud head 8 against the inwardly cambered sections 62 and holding it in the spacing rail 50.

In this form the spacing rail 50 also ensures that the position of the studs 6 is maintained in the reinforced concrete slab, in particular the preset spacing of the studs.

In the example shown in FIGS. 11–13, the cross sections of the spacing rail 50 and the flexural rigidity of the spacing rail ensure that the concrete is confined behind the anchor head 8. The concrete behind the anchor head 8 is confined between the outward edges of the flanges 58 and the cone shape of the anchor head 8. This increases the compressive strength of the concrete and allows the use of smaller stud heads 8 than without the aforementioned detail. Finally, the spacing rail 50 also distributes the anchorage forces to an area larger than the stud head 8 itself The flexural rigidity of the U-shaped spacing rail 50 enables the transfer of the anchorage forces along a portion of the spacing rail 50. This also allows to choose a relatively small diameter for the stud head 8.

In FIG. 14 it is shown that both heads 8 of a stud 6 can be attached to a spacing rail 50 or 64, respectively. It is also possible to attach the stud head 8 at the opposite end of spacing rail 50 to a correspondingly shaped rail segment 65.

A second continuous spacing rail 64 can also be used if this rail does not interfere with the placement of further reinforcing elements. If there are other reinforcing elements placed perpendicular to the spacing rail, as for example in a reinforced concrete slab, rail segments 65 can be used. The gap 66 simplifies the placement of further reinforcing elements. To achieve larger gaps 66 the rail section 65 can be turned through 90° as shown on the left hand side of FIG. 14.

FIG. 15 shows a greatly simplified schematic of a production of the studrails 1 shown and described in FIG. 1, 2 and 4. A strip of sheet metal 18 is unreeled from a sheet metal coil 17. In a punch press 19 holes 14 and/or spacer openings 15 are punched out as shown in FIGS. 9 and 10.

In a roll-forming machine 20 following the sheet metal strip 18 the flanges of the strip are rolled upwards. In the rail formed in this way one stud head 8 is inserted from a stud magazine 6. The flanges 10 of the sheet metal strip 18 are folded afterwards to fasten the stud heads 8. This may be achieved by using rollers 21. Afterwards the rail segments 18 with mounted studs 6 are cut to the desired length using a cutter 22. The cutter 22 can also be placed before the stud 6 are inserted, as shown in FIG. 15 with a dashed-dotted line.

While the edges of the sheet metal band 18 are formed upwards by using a rolling process as described in the design example, this can also be done by bending the edges of the sheet metal strip in a bending machine. Instead of folding the edges of the sheet metal strip 18 to fasten the studs 6 in a rolling process as described above, the edges of the sheet metal strip 18 can also be folded in a bending process.

We claim:

1. A studrail for shear reinforcement of a reinforced concrete member comprises a spacing rail (5, 50) and a pluraity of studs (6) arranged parallel to each other and secured at one end to the spacing rail (5, 50), each of said studs consisting of an elongate shaft (7) which is provided at both ends with an enlarged dish-shaped anchor head (8), said spacing rail (5, 50) consisting of a sheet metal rail having a web (9, 52) which contacts a front end of the anchor heads (8) and which holds the two opposite edges **(8*a*) of each anchor head (8) with two folded edges (10, 54) of the spacing rail (10, 54) wherein inner face of the web (9) is provided with projecting stops (11, 13)** arranged at equal interval in the longitudinal direction of the rail.

2. Studrail according to claim 1, in which the edges of the spacing rail (10, 54) clamp the edges of the anchor heads **(8*a*)**.

3. Studrail according to claim 1, in which the anchor heads (8) can be moved over a limited length along the spacing rail (5).

4. Studrail according to claim 1, in which the stops are punched out of the web (9) of the spacing rail forming metal lips (13).

5. Studrail according to claim 1, in which the stops are lugs (11) projecting from the surface of the web (9) and fitting into a central depression (12) in the anchor head (8).

6. Studrail according to claim 1, in which the web (9) is provided with perforations (14).

7. Studrail according to claim 1, including a plurality of chairs (16) and openings (15) provided in the plane of the web (9) for the installation of said chairs (16).

8. Studrail according to claim 7, in which the chairs (16) can be moved in the opening (15) in the direction of the longitudinal axis of the studrail.

9. Studrail according to claim 1, in which the two flanges (54) of the spacing rail (50) are provided with an outward curvature towards the flange edge (58).

10. Studrail according to claim 9, in which the flanges are S-shaped in cross section, producing an outward bent clamping segment (56) for each anchor head (8) adjacent to the web face (52) of the section as well as an inward bent segment (62) adjacent to the flange edge (58).

11. Studrail according to claims 1, in which the web (52) is convex towards the inside face of the web.

12. Studrail according to claim 1, in which both anchor heads of a stud (6) are connected with a spacing rail (50 or 64) or with an appropriately shaped rail segment (65).

13. Process to manufacture a studrail according to claim 1 characterized by the following manufacturing steps:

a) a metal strip is pulled from a coil of metal strips;

b) the edges of the metal strip are bent up and projecting stops are formed on the inner face of the web,;

c) in the metal strip thus formed the studs are inserted at one of the anchor heads,;

d) the bent-up flanges of the molded metal strip are bent over to clamp the anchor heads.

14. Process according to claim 13, in which segments provided with studs are cut from the formed metal strip.

15. Process according to claim 13, in which the flanges of the metal strip are bent up by a rolling process.

16. Process according to claim 13, in which the flanges of the metal strip are produced by a bending process.

17. Process according to claim 13, in which the flanges of the metal strip are folded over by a rolling process.

18. Process according to claim 13, in which the flanges of the metal strip are folded over by a bending process.

19. Process according to claim 13 in which the metal strip is perforated.

* * * * *